United States Patent [19]

Hall

[11] 4,304,206

[45] Dec. 8, 1981

[54] FUEL TANK VAPOR CONDENSATE TRAP

[75] Inventor: John F. Hall, Bloomfield Hills, Mich.

[73] Assignee: Chrysler Corporation, Highland Park, Mich.

[21] Appl. No.: 80,357

[22] Filed: Sep. 28, 1979

[51] Int. Cl.[3] ..... F02B 39/00

[52] U.S. Cl. ..... 123/518; 137/192

[58] Field of Search ..... 137/192; 123/518, 519, 123/520, 521

[56] References Cited

U.S. PATENT DOCUMENTS 1,448,972 3/1923 Long ..... 137/192
2,390,749 12/1945 Swift ..... 137/192 X
3,191,587 6/1965 Hall ..... 123/518
3,209,738 10/1965 Powers ..... 137/192 X

*Primary Examiner*—Alan Cohan
*Attorney, Agent, or Firm*—Newtson & Dundas

[57] ABSTRACT

In a vehicle with a vapor fuel vent conduit between the fuel tank and a vapor storage means, a liquid fuel condensate trap and dump valve which opens in response to a given liquid level to discharge liquid fuel back to the fuel tank or to the fuel pump. The preferred embodiment provides a hollow housing with three ports and containing a float type valve which moves from a valve seat in response to liquid level.

1 Claim, 3 Drawing Figures

FUEL TANK VAPOR CONDENSATE TRAP

This invention relates to a vehicle fuel vent system and particularly to a liquid fuel condensate trap and valving assembly located in a fuel vapor conduit between a vehicle fuel tank and a fuel vapor storage means.

Presently, vehicles utilize a fuel vapor storage canister located in the engine compartment to temporarily store vapors emitted from the fuel tank and the carburetor fuel bowl. The vapor storage canister is connected to the engine air intake so that the vapor stored therein are periodically discharged to the operative engine. The fuel storage canister commonly takes the form of a plastic housing having a hollow interior filled with activated charcoal. As maximum allowed emission standards, particularly as to unburned hydrocarbons, progressively decrease, the vapor storage canisters have become progressively larger to accommodate a greater quantity of vapor. Thus it becomes of considerable importance to minimize the quantity of fuel vapor passing to the storage canister. The canister is located in the engine compartment and the vehicle fuel tank is located toward the rear of the vehicle. A conduit extends therebetween so that fuel vapors are directed to the storage canister rather than to atmosphere. This conduit often has a temperature less than the fuel tank or the engine compartment due to its exposed location and thus a part of the vapor passing through the line may condense. The passage of liquid fuel to the vapor storage canister is undesirable since the canister has only a finite capacity and any liquid would contribute greatly to filling it. Thus the present invention provides a fuel vent system with a liquid condensate trap and automatic dump valve to discharge liquid back to the fuel tank.

The subject valve is simple in construction and operates by means of a float type valve located in a hollow housing positioned at a low point in the fuel vapor conduit and near the canister. The conduit extends between the fuel tank and the vapor storage means. Thus the discharge of liquid fuel into the vapor storage is effectively prevented. Other advantages and objects of the present invention will be more readily apparent from the following detailed description reference being had to the drawings in which a preferred embodiment of the invention is illustrated.

IN THE DRAWINGS

Figure 1:
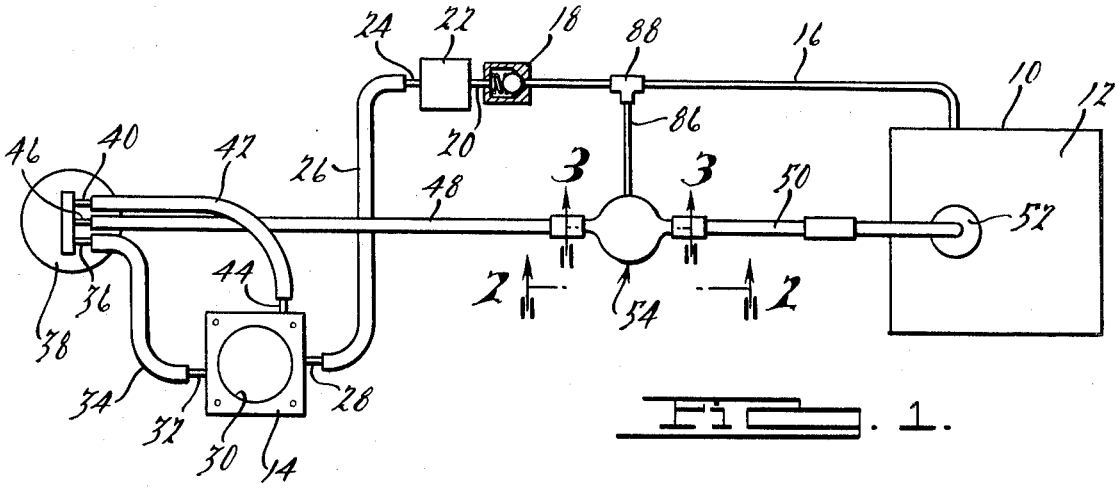
FIG. 1 is a partially schematic illustration of a vehicle fuel system.

In FIG. 1 a partially schematic planar view of the vehicle fuel system is shown with a fuel tank 10 and top 12 of which is visible in FIG. 1. A carburetor 14 adapted for support on an engine (not shown) receives fuel from the tank through a conduit 16. A fuel pump 22 has an inlet 20 connected to conduit 16 and includes a spring biases check or inlet valve assembly 18. The fuel pump 22 may be an electrically or mechanically driven pump attached to the vehicle engine. The outlet 24 of the pump is attached by a conduit 26 to the inlet 28 of the carburetor 14. Fuel passes through the inlet 28 of the carburetor into a fuel bowl therein in a conventional manner. Fuel flow to the fuel bowl is controlled by a float actuated needle valve which maintains a predetermined liquid level within the fuel bowl. Fuel than passes from the fuel bowl into the internal throat 30 of the carburetor through which large quantities of air flow during vehicle operation.

The upper part of the float bowl portion of carburetor 14 is connected by a fitting 32 and conduit 34 to an inlet fitting 36 of a vapor storage means or canister 38. This upper portion of the fuel bowl is normally rich in fuel vapors and the vapor storage canister 38 prevents the escape of the fuel vapors to atmosphere. Normally the canister 38 consists of a hollow plastic container which is filled with activated charcoal and has a lower air inlet, several vapor inlets and an outlet. The outlet 40 is connected by conduit 42 to an inlet fitting 44 of the carburetor 14. The inlet fitting 44 communicates with a low pressure area of passage 30 so as to draw vapors from the storage means 38 during engine operation. This effectively rejuvenates the storage capacity of the activated charcoal.

Figure 2:
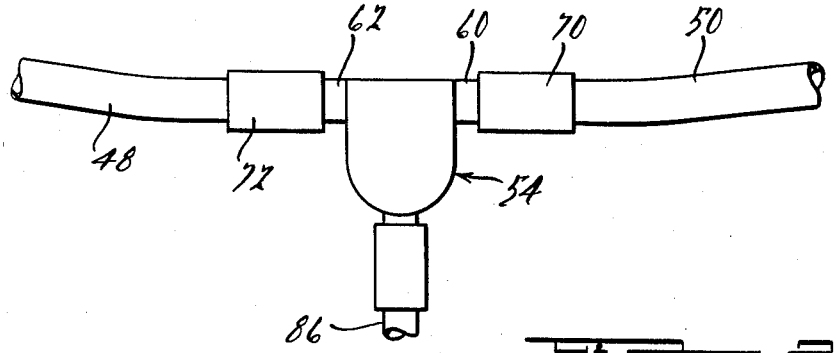
FIG. 2 is an elevational view of the fuel dump valve assembly shown in FIG. 1 and looking in the direction of arrows 2—2 therein.
Figure 3:
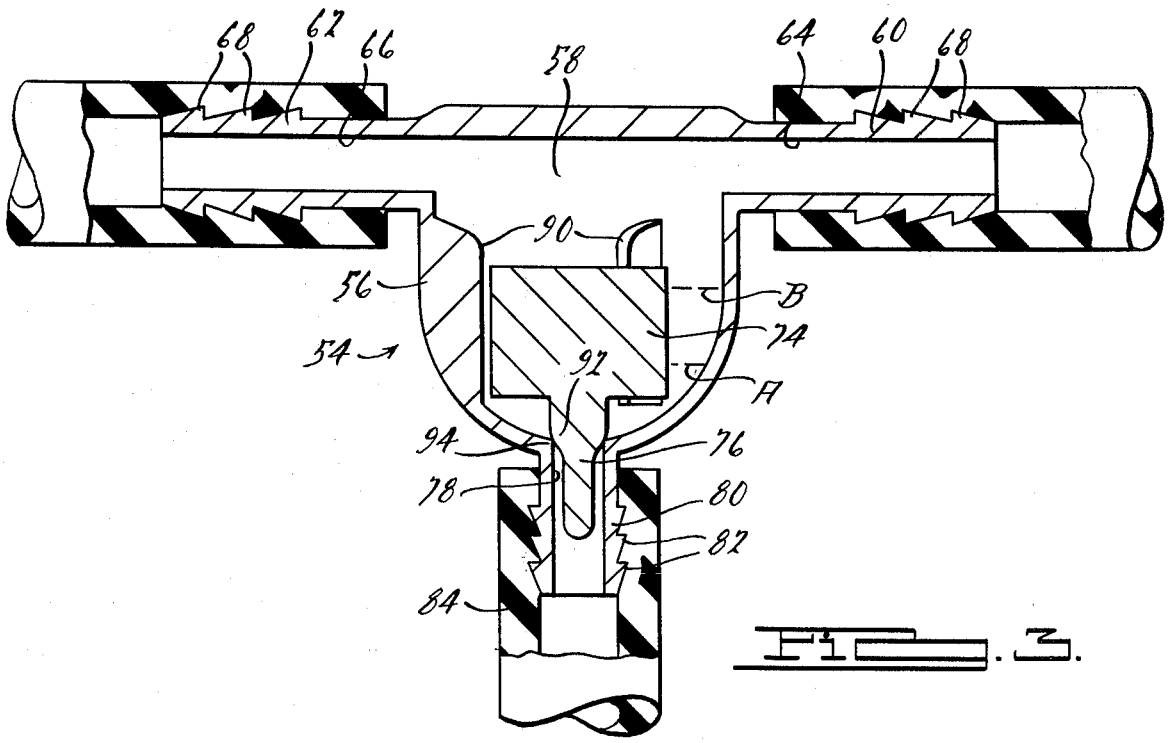
FIG. 3 is an enlarged fragmentary view of the fuel cutoff valve taken along line 3—3 in FIG. 1 and looking in the direction of the arrows.

Another inlet fitting 46 of the canister 38 is connected by interconnected metal conduits 48,50 to the upper portion of the fuel tank 12 by a fitting 52 on the top of tank 12. This provides a vent for fuel vapors to the storage canister 38 and thus prevents escape of the fuel vapors to atmosphere. Simultaneously liquid fuel in the tank may expand without pressurizing the tank. Between the conduits 48 and 50 is located a liquid fuel collection and dump assembly 54 shown in FIGS. 2 and 3. The fuel collector and dump includes a thin walled metal housing 56 which defines an interior space 58. An inlet and outlet fitting 60,62 defines passages 64 and 66 respectively connected by the interior space 58. The inlet and outlet 60,62 are attached to the conduits 50 and 48 respectively by short lengths elastomeric connectors 70 and 72. The elastomeric connectors 70 and 72 encircle the fittings 60,62 and ribs 68 thereon engage the connectors to insure a leakfree and secure connection.

The interior 58 of assembly 54 houses a small float valve assembly 74 of fuel resistant material and having an upper portion adapted to float in a certain quantity of liquid fuel which collects in the lower portion of interior 58. A contoured needle valve part 76 depends from the main body portion of the assembly 74 which is integral therewith. The needle valve portion 76 extends into an outlet passage 78 formed by a bottom outlet fitting 80. Like fittings 60,62, a series of rib portions 82 provide a good sealing fit with an elastomeric connector 84. The connector 84 attaches to metallic conduit 86 which extends from the assembly 52 to a fitting 88 in the conduit 16 thereby to return liquid fuel to the fuel supply line upstream from pump 22.

Within interior 58 of member 54, the float assembly 74 is maintained with needle valve portion 76 in alignment with passage 78 by a plurality of inwardly extending tab portions 90. The tabs 90 maintain the float assembly 74 so that the enlarged diameter portion 92 thereof engages a valve seat portion 94 formed around the passage 78 when the liquid level is low such as level A in FIG. 3. However, when the liquid level in the interior 58 increases to level B, for instance, the float assembly 74 moves upward to cause the enlarged portion 92 to disengage from seat portion 94. Resultantly, liquid fuel than flows into passage 78 and hence to the fuel line 16. Subsequently, the float assembly again seals the passage 78. Liquid fuel which condenses in the conduits 48 and 50 runs downward within the sloping conduits and into the liquid fuel trap assembly 54 is thus kept from the canister.

Although one embodiment of the present invention has been described in detail and disclosed in the drawings, modifications will be readily apparent to a skilled person in the art which would still fall within the scope of the following claims which define the invention.

I claim:

1. A vehicle fuel vent system to prevent the escape to atmosphere of hydrocarbons without first passing through the vehicle engine, comprising: a fuel tank to store mostly liquid hydrocarbon fuel; a liquid fuel delivery means including a conduit extending from the bottom portion of the fuel tank to the engine and including a fuel pump means between the engine and the fuel tank; a hydrocarbon vapor storage means having an inlet; a vaporous fuel vent line extending from the upper portion of the fuel tank to the inlet of the vapor storage means, a liquid fuel collecting and discharge valve assembly including a hollow housing having inlet and outlet fittings which define passages to an upper portion of the interior of the hollow housing; the inlet and outlet fittings being connected to the vent line in a manner to cause vaporous fuel to pass through the housing interior between the inlet and outlet thereof and to cause any liquid fuel which may condense in the vent line to flow into the housing interior and collect in the bottom portion thereof; the hollow housing also having a lower outlet fitting defining a discharge passage extending from the bottom portion of the housing interior for discharging liquid fuel therefrom; conduit means extending from the lower outlet fitting and communicating between the drain passage and the fuel delivery conduit at a location between the fuel tank and the fuel pump means for returning liquid fuel to the fuel tank; valve means normally closing the drain passage and being responsive to a given quantity of liquid fuel collected in the housing interior from condensed fuel in the vent line to automatically discharge liquid fuel from the housing to the conduit means whenever a certain liquid quantity has been collected therein.

* * * * *